United States Patent [19]

Campbell

[11] Patent Number: 4,877,416

[45] Date of Patent: Oct. 31, 1989

[54] SYNERGISTIC FUEL COMPOSITIONS

[75] Inventor: Curtis B. Campbell, Rodeo, Calif.

[73] Assignee: Chevron Research Company, San Francisco, Calif.

[21] Appl. No.: 121,986

[22] Filed: Nov. 18, 1987

[51] Int. Cl.[4] ..... C10L 1/18; C10L 1/22

[52] U.S. Cl. ..... 44/62; 44/72; 44/77

[58] Field of Search ..... 44/72, 77, 62

[56] References Cited

U.S. PATENT DOCUMENTS

| | | | |
|---|---|---|---|
| 3,438,757 | 4/1969 | Honnen et al. | 44/58 |
| 3,440,029 | 4/1969 | Little et al. | 44/72 |
| 3,565,804 | 2/1971 | Honnen et al. | 252/50 |
| 3,574,576 | 4/1971 | Honnen et al. | 44/72 |
| 3,671,511 | 6/1972 | Honnen et al. | 260/93.7 |
| 3,756,793 | 9/1973 | Robinson | 44/62 |
| 3,756,795 | 9/1973 | Rosenwald | 44/72 |
| 4,160,648 | 7/1979 | Lewis et al. | 44/63 |
| 4,247,301 | 1/1981 | Honnen | 44/72 |
| 4,329,240 | 5/1982 | Lilburn | 44/72 |
| 4,410,335 | 10/1983 | Childs | 44/72 |
| 4,526,587 | 7/1985 | Campbell | 44/72 |
| 4,548,616 | 10/1985 | Sung et al. | 44/77 |
| 4,599,090 | 7/1986 | Steckel | 44/72 |

FOREIGN PATENT DOCUMENTS 3631225 4/1987 Fed. Rep. of Germany .

*Primary Examiner*—William R. Dixon, Jr.
*Assistant Examiner*—E. McAvoy
*Attorney, Agent, or Firm*—C. J. Caroli; R. C. Gaffney

[57] ABSTRACT

Disclosed is a synergistic fuel composition containing a hydrocarbyl-substituted amine or polyamine and a poly(oxyalkylene) monool. These compositions provide for an unexpected decrease in those deposits which have been correlated to Octane Requirement Increase (ORI).

12 Claims, No Drawings

SYNERGISTIC FUEL COMPOSITIONS

BACKGROUND OF THE INVENTION

1. Field of the Invention

Numerous deposit-forming substances are inherent in hydrocarbon fuels. These substances, when used in internal combustion engines, tend to form deposits on and around constricted areas of the engine contacted by the fuel. Typical areas commonly and sometimes seriously burdened by the formation of deposits include carburetor ports, the throttle body and venturies, engine intake valves, etc.

Deposits adversely affect the operation of the vehicle. For example, deposits on the carburetor throttle body and venturies increase the fuel to air ratio of the gas mixture to the combustion chamber thereby increasing the amount of unburned hydrocarbon and carbon monoxide discharged from the chamber. The high fuel-air ratio also reduces the gas mileage obtainable from the vehicle.

Deposits on the engine intake valves when they get sufficiently heavy, on the other hand, restrict the gas mixture flow into the combustion chamber. This restriction, starves the engine of air and fuel and results in a loss of power. Deposits on the valves also increase the probability of valve failure due to burning and improper valve seating. In addition, these deposits may break off and enter the combustion chamber possibly resulting in mechanical damage to the piston, piston rings, engine head, etc.

The formation of these deposits can be inhibited as well as removed by incorporating an active detergent into the fuel. These detergents function to cleanse these deposit-prone areas of the harmful deposits, thereby enhancing engine performance and longevity. There are numerous detergent-type gasoline additives currently available which, to varying degrees, perform these functions.

The use of detergent-type gasoline additives is complicated by a phenomenon termed "Octene Requirement Increase "("ORI"). In particular, with regard to automobile engines that require the use of nonleaded gasolines (to prevent disablement of catalytic converters used to reduce emissions), it has been found difficult to provide gasoline of high enough octane to prevent knocking and the concomitant damage which it causes. The chief problem lies in the area of the degree of octane requirement increase, herein called "ORI", which is caused by deposits formed by the commercial gasoline.

The basis of the ORI problem is as follows: each engine, when new, requires a certain minimum octane fuel in order to operate satisfactorily without pinging and/or knocking. As the engine is operated on any gasoline, this minimum octane increases and, in most cases, if the engine is operated on the same fuel for a prolonged period, will reach an equilibrium. This is apparently caused by an amount of deposits in the combustion chamber. Equilibrium is typically reached after 5,000 to 15,000 miles of automobile operation.

The octane requirement increase in particular engines used with commercial gasolines will vary at equilibrium from 5 to 6 octane units to as high as 12 or 15 units, depending upon the gasoline compositions, engine design and type of operation. The seriousness of the problem is thus apparent. A typical automobile with a research octane requirement of 85, when new, may after a few months of operation require 97 research octane gasoline for proper operation, and little unleaded gasoline of that octane is available. The ORI problem also exists in some degree with engines operated on leaded fuels. U.S. Pat. Nos. 3,144,311; 3,146,203; and 4,247,301 disclose lead-containing fuel compositions having reduced ORI properties.

The ORI problem is compounded by the fact that the most common method for increasing the octane rating of unleaded gasoline is to increase its aromatic content. This, however, eventually causes an even greater increase in the octane requirement.

This ORI problem is recognized to be particularly significant with fuels, especially unleaded fuels, containing hydrocarbyl-substituted polyamine fuel additives. Accordingly, while certain hydrocarbyl-substituted polyamine additives are well known in the art as excellent dispersant/detergent fuel additives which have been commercially successful in leaded gasolines, the ORI problem associated with these additives have prevented their commercial use in unleaded gasolines. Accordingly, it would be particularly advantageous to develop a fuel composition containing such hydrocarbyl-substituted polyamine additives which would reduce to an acceptable level the ORI associated with these additives.

The instant invention is directed to synergistic fuel compositions containing a hydrocarbyl-substituted amine or polyamine and a hydrocarbyl-terminated poly(oxyalkylene) monool. These compositions provide for an unexpected decrease in those deposits which have been correlated to ORI.

2. Prior Art

Hydrocarbyl-substituted polyamines useful as fuel additives are known in the art and are disclosed in U.S. Pat. Nos. 3,438,757; 3,565,804; 3,574,576; and 3,671,511.

Likewise, the use of poly(oxyalkylene) diols as an additive in fuel compositions is disclosed in U.S. Pat. No. 4,548,616 which discloses the use of block copolymers as an ORI additive. U.S. Pat. No. 3,756,793 discloses fuel compositions containing a combination of a hydrocarbyl polyamine with a polyether glycol and etherified and esterfied products thereof.

U.S. Pat. No. 4,160,648 discloses certain polyether carbamates as fuel additives possessing good ORI properties and further discloses that poly(oxyalkylene) monools and polyols display synergistic effects when combined with such polyether carbamates in fuel compositions.

However, these references neither disclose the combination of hydrocarbyl-substituted polyamines with a $C_1$–$C_{30}$ hydrocarbyl-terminated poly(oxyalkylene) monool nor do any of these references teach that such a combination would synergistically result in lower ORI for such fuel compositions.

SUMMARY OF THE INVENTION

The present invention is directed toward a synergistic fuel composition which contains a hydrocarbyl-substituted amine or polyamine and a hydrocarbyl-terminated poly(oxyalkylene) monool. In particular, the present invention is directed to a fuel composition comprising a major portion of hydrocarbons boiling in the gasoline range and (a) from about 0.001% by weight to about 1.0% by weight of a hydrocarbyl-substituted amine or polyamine having an average molecular weight of about 750 to about 10,000 and also having at least one basic nitrogen atom, and (b) a hydrocarbyl-terminated poly(oxyalkyline) monool having an average molecular weight from about 500 to about 5,000 wherein said oxyalkylene group of the hydrocarbyl-terminated poly(oxyalkylene) monool is a $C_2$ to $C_5$ oxyalkylene group and the hydrocarbyl group of said hydrocarbyl-terminated poly(oxyalkylene) monool is a $C_l$ to $C_{30}$ hydrocarbyl group and wherein the weight percent of the hydrocarbyl-terminated poly(oxyalkylene) monool in the fuel composition ranges from about 0.01 to 100 times the amount of hydrocarbyl-substituted amine or polyamine.

The compositions of this invention provide for reduction in ORI as compared to fuel compositions containing only the hydrocarbyl-substituted amine or polyamine additive. Thus, in its method aspect, the instant invention is directed to a method of reducing the ORI of a fuel composition containing a hydrocarbyl-substituted amine or polyamine which comprises adding a hydrocarbyl-terminated poly(oxyalkylene) monool having a molecular weight of from about 500 to about 5,000 wherein said oxyalkylene of the hydrocarbyl-terminated poly(oxyalkylene) monool is a $C_2$ to $C_5$ oxyalkylene group and the hydrocarbyl group of said hydrocarbyl-terminated poly(oxyalkylene) monool is a $C_l$ to $C_{30}$ hydrocarbyl group and wherein the weight percent of the hydrocarbyl-terminated poly(oxyalkylene) monool in the fuel composition ranges from about 0.01 to 100 times the amount of hydrocarbyl-substituted amine or polyamine.

DETAILED DESCRIPTION OF THE INVENTION

As noted above, the fuel compositions of this invention contain a hydrocarbyl-substituted amine or polyamine and a hydrocarbyl-terminated poly(oxyalkylene) monool. These components are described in detail below:

A. Hydrocarbyl-Substituted Amines or Polyamines

The hydrocarbyl-substituted polyamines employed in this invention are well known and are disclosed in U.S. Pat. Nos. 3,438,757 and 3,394,576. A method for their preparation is found in U.S. Pat. Nos. 3,565,804 and 3,671,511; the disclosure of which is hereby incorporated by reference.

The hydrocarbyl-substituted amines employed in this invention are prepared by reacting a hydrocarbyl halide (i.e., chloride) with ammonia or a primary or secondary amine to produce the hydrocarbyl-substituted amine.

The hydrocarbyl-substituted amines and polyamines are high-molecular-weight hydrocarbyl-N-substituted amines or polyamines containing at least one basic nitrogen. The hydrocarbyl group has an average molecular weight in the range of about 750–10,000 more usually in the range of about 1000–5000.

The hydrocarbyl radical may be aliphatic or alicyclic and, except for adventitious amounts of aromatic structure in petroleum mineral oils, will be free of aromatic unsaturation. The hydrocarbyl groups will normally be branched-chain aliphatic, having 0–2 sites of unsaturation, and preferably from 0–1 site of ethylene unsaturation. The hydrocarbyl groups are preferably derived from petroleum mineral oil, or polyolefins, either homopolymers or higher-order polymers, or 1-olefins of from 2–6 carbon atoms. Ethylene is preferably copolymerized with a higher olefin to insure fuel solubility.

Illustrative polymers include polypropylene, polyisobutylene, poly-1-butene, etc. The polyolefin group will normally have at least 1 branch per 6 carbon atoms along the chain, preferably at least 1 branch per 4 carbon atoms along the chain. These branched-chain hydrocarbons are readily prepared by the polymerization of olefins of from 3–6 carbon atoms and preferably from olefins of from 3–4 carbon atoms.

In preparing the compositions of this invention, rarely will a single compound having a defined structure be employed. With both polymers and petroleum-derived hydrocarbon groups, the composition is a mixture of materials having various structures and molecular weights. Therefore, in referring to molecular weight, average molecular weights are intended. Furthermore, when speaking of a particular hydrocarbon group, it is intended that the group include the mixture that is normally contained within materials which are commercially available. For example, polyisobutylene is known to have a range of molecular weights and may include small amounts of very high molecular-weight materials.

Particularly preferred hydrocarbyl-substituted amines or polyamines are prepared from polyisobutenyl chloride.

The polyamine employed to prepare the hydrocarbyl-substituted polyamine is preferably a polyamine having from 2 to about 12 amine nitrogen atoms and from 2 to about 40 carbon atoms. The polyamine is reacted with a hydrocarbyl halide (i.e., chloride) to produce the hydrocarbyl-substituted polyamine, employed in this invention. The polyamine is so selected so as to provide at least one basic amine in the hydrocarbyl-substituted polyamine. The polyamine preferably has a carbon-to-nitrogen ratio of from about 1:1 to about 10:1.

The amine portion of the hydrocarbyl-substituted amine may be substituted with substituents selected from (A) hydrogen, and (B) hydrocarbyl groups of from 1 to about 10 carbon atoms.

The polyamine portion of the hydrocarbyl-substituted polyamine may be substituted with substituents selected from (A) hydrogen, (B) hydrocarbyl groups of from 1 to about 10 carbon atoms, (C) acyl groups of from 2 to about 10 carbon atoms, and (D) monoketo, monohydroxy, mononitro, monocyano, lower alkyl and lower alkoxy derivatives of (B) and (C). "Lower", as used in terms like lower alkyl or lower alkoxy, means a group containing from 1 to about 6 carbon atoms.

At least one of the nitrogens in the hydrocarbyl-substituted amine or polyamine is a basic nitrogen atom, i.e., one tetratable by a strong acid.

Hydrocarbyl, as used in describing the amine or polyamine substituents of this invention, denotes an organic radical composed of carbon and hydrogen which may be aliphatic, alicyclic, aromatic or combinations thereof, e.g., aralkyl. Preferably, the hydrocarbyl group will be relatively free of aliphatic unsaturation, i.e., ethylenic and acetylenic, particularly acetylenic unsaturation. The substituted polyamines of the present invention are generally, but not necessarily, N-substitutd polyamines. Exemplary hydrocarbyl groups and substituted hydrocarbyl groups include alkyls such as methyl, ethyl, propyl, butyl, isobutyl, pentyl, hexyl, octyl, etc., alkenyls such as propenyl, isobutenyl, hexenyl, octenyl, etc., hydroxy alkyls, such as 2-hydroxyethyl, 3-hydroxypropyl, hydroxyisopropyl, 4-hyroxybutyl, etc., ketoalkyls, such as 2-ketopropyl, 6-ketooctyl, etc., alkoxy and lower alkenoxy alkyls, such as ethoxyethyl, ethoxypropyl, propoxyethyl, propoxypropyl, 2-(2-ethoxyethoxy)ethyl, 2-(2-(2-ethoxyethoxy)ethoxy)ethyl, 3,6,9,12-tetraoxatetradecyl, 2-(2-ethoxyethoxy)hexyl, etc.

Typical amines useful in preparing the hydrocarbyl-substituted amines employed in this invention include methylamine, dimethylamine, ethylamine, diethylamine, n-propylamine, di-n-propylamine, etc. Such amines are either commercially available or are prepared by art recognized procedures.

The polyamine component also may contain heterocyclic polyamines, heterocyclic substituted amines and substituted heterocyclic compounds, wherein the heterocycle comprises one or more 5–6 membered rings containing oxygen and/or nitrogen. Such heterocycles may be saturated or unsaturated and substituted with groups selected from the aforementioned (A), (B), (C) and (D). The heterocycles are exemplified by piperazines, such as 2-methylpiperazine, 1,2-bis-(N-piperazinyl)ethane, and N,N'-bis(N-piperazinyl)piperazine, 2-methylimidazoline, 3-aminopiperidine, 2-aminopyridine, 2-(betaaminoethyl)-3-pyrroline, 3-aminopyrrolidine, N-(3-aminopropyl)morpholine, etc. Among the heterocyclic compounds, the piperazines are preferred.

Typical polyamines that can be used to form the compounds of this invention include the following: ethylene diamine, 1,2-propylene diamine, 1,3-propylene diamine, diethylene triamine, triethylene tetramine, hexamethylene diamine, tetraethylene pentamine, methylaminopropylene diamine, N-(betaaminoethyl)piperazine, N,N'-di(betaaminoethyl)piperazine, N,N'-di(-betaaminoethyl)imidazolidone-2, N-(beta-cyanoethyl)ethane-1,2-diamine, 1,3,6,9-tetraaminooctadecane, 1,3,6-triamino-9-oxadecane, N-methyl-1,2propanediamine, 2-(2-aminoethylamino)-ethanol.

Another group of suitable polyamines are the propyleneamines, (bisaminopropylethylenediamines). Propyleneamines are prepared by the reaction of acrylonitrile with an ethyleneamine, for example, an ethyleneamine having the formula $H_2N(CH_2CH_2NH)_ZH$ wherein Z is an integer from 1 to 5, followed by hydrogenation of the resultant intermediate. Thus, the product prepared from ethylene diamine and acrylonitrile would be $H_2N(CH_2)_3NH(CH_2)_2NH(CH_2)_3NH_2$.

In many instances the polyamine used as a reactant in the production of hydrocarbyl-substituted polyamine of the present invention is not a single compound but a mixture in which one or several compounds predominate with the average composition indicated. For example, tetraethylene pentamine prepared by the polymerization of aziridine or the reaction of dichloroethylene and ammonia will have both lower and higher amine members, e.g., triethylene tetramine, substituted piperazines and pentaethylene hexamine, but the composition will be largely tetraethylene pentamine and the empirical formula of the total amine composition will closely approximate that of tetraethylene pentamine. Finally, in preparing the hydrocarbyl-substituted polyamines for use in this invention, where the various nitrogen atoms of the polyamine are not geometrically equivalent, several substitutional isomers are possible and are encompassed within the final product. Methods of preparation of polyamines and their reactions are detailed in Sidgewick's "The Organic Chemistry of Nitrogen", Clarendon Press, Oxford, 1966; Noller's "Chemistry of Organic Compounds", Saunders, Philadelphia, 2nd Ed., 1957; and Kirk-Othmer's "Encyclopedia of Chemical Technology", 2nd Ed., especially Volumes 2, pp. 99–116.

The preferred hydrocarbyl-substituted polyalkylene polyamines for use in this invention may be represented by the formula $$R_1NH\text{-}(R_2\text{—}NH)_a H \qquad \text{II}$$

wherein $R_1$ is hydrocarbyl having an average molecular weight of from about 750 to about 10,000; $R_2$ is alkylene of from 2 to 6 carbon atoms; and a is an integer of from 0 to about 10.

Preferably, $R_1$ is hydrocarbyl having an average molecular weight of from about 1,000 to about 10,000. Preferably, $R_2$ is alkylene of from 2 to 3 carbon atoms and a is preferably an integer of from 1 to 6.

B. Hydrocarbyl-terminated Poly(oxyalkylene) Monools.

The hydrocarbyl-terminated poly(oxyalkylene) polymers employed in the present invention are monohydroxy compounds, i.e., alcohols, often termed monohydroxy polyethers, or polyalkylene glycol monohydrocarbylethers, or "capped" poly(oxyalkylene) glycols and are to be distinguished from the poly(oxyalkylene) glycols (diols), or polyols, which are not hydrocarbyl-terminated, i.e., not capped. The hydrocarbyl-terminated poly(oxyalkylene) alcohols are produced by the addition of lower alkylene oxides, such as ethylene oxide, propylene oxide, the butylene oxides, or the pentylene oxides to the hydroxy compound $R_3OH$ under polymerization conditions, wherein $R_3$is the hydrocarbyl group which caps the poly(oxyalkylene) chain. Methods of production and properties of these polymers are disclosed in U.S. Pat. Nos. 2,841,479 and 2,782,240 and the aforementioned Kirk-Othmer's "Encyclopedia of Chemical Technology", Volume 19, p. 507. In the polymerization reaction a single type of alkylene oxide may be employed, e.g., propylene oxide, in which case the product is a homopolymer, e.g., a poly(oxyalkylene) propanol. However, copolymers are equally satisfactory and random copolymers are readily prepared by contacting the hydroxyl-containing compound with a mixture of alkylene oxides, such as a mixture of propylene and butylene oxides. Block copolymers of oxyalkylene units also provide satisfactory poly(oxyalkylene) polymers for the practice of the present invention. Random polymers are more easily prepared when the reactivities of the oxides are relatively equal. In certain cases, when ethylene oxides is copolymerized with other oxides, the higher reaction rate of ethylene oxide makes the preparation of random copolymers difficult. In either case, block copolymers can be prepared. Block copolymers are prepared by contacting the hydroxyl-containing compound with first one alkylene oxide, then the others in any order, or repetitively, under polymerization conditions. A particular block copolymer is represented by a polymer prepared by polymerizing propylene oxide on a suitable monohydroxy compound to form a poly(oxypropylene) alcohol and then polymerizing butylene oxide on the poly(oxyalkylene) alcohol.

In general, the poly(oxyalkylene) polymers are mixtures of compounds that differ in polymer chain length. However, their properties closely approximate those of the polymer represented by the average composition and molecular weight.

The polyethers employed in this invention can be represented by the formula $R_4O—R_3O—_pH$ wherein $R_4$ is a hydrocarbyl group of from 1 to 30 carbon atoms; $R_3$ is a $C_2$ to $C_5$ alkylene group; and p is an integer, such that the molecular weight of the polyether is from about 500 to about 5,000.

Preferably, $R_3$ is a $C_3$ or $C_4$ alkylene group.

Preferably, $R_4$ is a $C_7$–$C_{30}$ alkylphenyl group.

Preferably, the polyether has a molecular weight of from about 750 to about 3,000; and more preferably from about 900 to about 1,500.

C. Fuel Compositions

The fuel employed in the fuel compositions of the instant invention is generally a hydrocarbon distillate fuel boiling in the gasoline range. The hydrocarbyl-substituted amine or polyamine as well as the hydrocarbyl-terminated poly(oxyalkylene) monool are generally added directly to the fuel at the desired concentrations. The hydrocarbyl-substituted amine or polyamine is added at a dispersant/detergent amount and in general at from about 0.001% by weight to about 1.0% by weight to the fuel, although preferably, at from about 0.02% by weight to about 0.1% by weight. The hydrocarbyl-terminated poly(oxyalkylene) monool is added to this composition at an amount to reduce ORI. In general, the hydrocarbyl-terminated poly(oxyalkylene) monool is added at from about 0.01 to 100 times the amount of hydrocarbyl-substituted amine or polyamine, although preferably at from about 1 to 50 times.

In gasoline fuels, other fuel additives may also be included, such as anti-knock agents, e.g., methylcyclopentadienyl manganese tricarbonyl, tetramethyl or tetraethyl lead, or other dispersants or detergents such as various substituted succinimides, amines, etc. Also included may be lead scavengers, such as aryl halides, e.g., dichlorobenzene or alkyl halides, e.g., ethylene dibromide. Additionally, antioxidants, metal deactivators and demulsifiers may be present.

The following examples are offered to specifically illustrate this invention. These examples and illustrations are not to be construed in any way as limiting the scope of this invention.

EXAMPLES

EXAMPLE 1

Preparation of Dodecylalkylphenyl-poly(oxybutylene)monool

A dried 5-liter, 3-neck round bottom flask fitted with a chilled water reflux condenser and mechanical stirrer was charged with 487 g (1.85 moles) of dodecylalkylphenol and 21.7 g (0.56 moles) of metallic potassium. The mixture was heated at 65° C. with stirring under a nitrogen atmosphere until metallation was complete. The pot temperature was then raised to 85° C. and 3980 ml (46.3 moles) of 1,2-epoxybutane was added at such a rate to maintain gentle reflux. After adding all the 1,2-epoxybutane, the pot temperature was raised to 115° C. to complete the reaction as indicated by no further refluxing. The reaction was cooled to approximately 70° C. and 350 $cm^3$ of Dowex hydrogen ion exchange resin was added to the reaction with stirring. After stirring approximately 45 minutes, the reaction was filtered through a medium porosity sintered glass Buchner filter funnel with the aid of vacuum to afford 2682 g of the title compound as a golden oil: molecular weight approximately 1500, hydroxyl number = 36.

EXAMPLE 2

Preparation of N-Polyisobutylenyl Ethylene Diamine

A 1-liter, 3-neck round bottom flask was charged with 150 g of polyisobutylene, average molecular weight approximately 950, and 160 ml of carbon tetrachloride and fitted with a chilled water condenser, gas dispersion tube and mechanical stirrer. The mixture was cooled to between 0°–5° C. with an ice-salt bath and 8.1 g (0.23 moles) of chlorine gas introduced via the gas dispersion tube at a rate of approximately 250 ml per minute with vigorous stirring. After adding the chlorine, the reaction was degassed with a nitrogen stream for 10 minutes and then stripped in-vacuo to afford 158.2 g of polybutene chloride containing 4.5 wt % chlorine.

A 250-ml, single-neck round bottom flask was charged with 75 g polybutene chloride (containing 0.96 moles of chlorine), 5 ml of xylenes, 21 ml of n-butanol and 26.6 ml (0.397 moles) of ethylenediamine. This flask was fitted with a Dean Stark distillation head, magnetic stir bar and the reaction mixture heated to 100° C. over approximately 20 minutes with vigourous stirring under a nitrogen atmosphere. The pot temperature was then raised to 150° C. and allowed to reflux for 30 minutes. The pot temperature was then raised to 160° C. and 21 ml of distillate (bp 130° C.) collected. The reaction was cooled to room temperature and transferred to a separatory funnel with the aid of toluene and washed with water until the water washings were neutral (pH paper). The use of n-butanol was required during washing to aid in decreasing emulsion formation. The organic layer was then dried over anhydrous potassium carbonate, filtered and stripped invacuo to afford 70.8 g of the title compound as a golden oil containing 1.71% basic nitrogen and 1.77% total nitrogen.

EXAMPLE 3

A method for determining whether or not a fuel additive is prone to causing ORI is to determine the residue it leaves behind in the thermal gravimetric analysis (TGA) experiment. In the TGA experiment, those additives which show less residue after being heated in an air atmosphere tend to be less prone to causing ORI.

The TGA procedure employed Du Pont 951 TGA instrumentation coupled with a microcomputer for data analysis. Samples of the fuel additives (Approximately 25 milligrams) were heated isothermally at 300° C. under air flowing at 60 cubic centimeters per minute. The weight of the sample was monitored as a function of time. Incremental weight loss is considered to be a first order process. Kinetic data, i.e., rate constants and half-lives, were readily determined from the accumulated TGA data. The half-life measured by this procedure represents the time it takes for half of the additive to decompose. Half-life data for a fuel additive correlates to the likelihood that that additive will contribute to ORI. Lower half-lives represent a more easily decomposable product—one which will not as likely accumulate and form deposits in the combustion chamber.

The compositions tested contained varying ratios of a dodecylphenyl poly(oxyalkylene) alcohol ("A") (prepared in a manner similar to that of Example 1) having an average molecular weight of approximately 1500 and a polyisobutenyl ethylene diamine ("B") (prepared in a manner similar to that of Example 2) having an average molecular weight of approximately 1500.

The weight loss of the compositions are shown in Table I below:

TABLE I

| Sample | Weight Loss (%) After 4 Min. | Weight Loss (%) After 30 Min. | Calculated Weight Loss Without Any Synergism Present (After 30 Min.) |
|---|---|---|---|
| 100% B | 17 | 37 | — |
| 100% A | 99 | 99 | — |
| 50% A/50% B | 30 | 92 | 68 |
| 25% B/75% A | 94 | 98 | 83.5 |
| 10% B/90% A | 99 | 99 | 92.8 |

The above data establishes thast the compositions of the instant invention synergetically provide for a reduction in those deposits which have been correlated to ORI.

What is claimed is:

1. A fuel composition comprising a major portion of hydrocarbons boiling in the gasoline range and (a) from about 0.001% by weight to about 1.0% by weight of a hydrocarbyl-substituted amine or polyamine having an average molecular weight of about 750 to about 10,000 and also having at least one basic nitrogen atom, and (b) a hydrocarbyl-terminated poly(oxyalkylene) monool having an average molecular weight from about 500 to 5000 wherein said oxyalkylene group of the hydrocarbyl-terminated poly(oxyalkylene) monool is a $C_2$to $C_5$ oxyalkylene group and the hydrocarbyl group of said hydrocarbyl-terminated poly(oxyalkylene) monool is a $C_7$–$C_{30}$ alkylphenyl group and wherein the weight percent of hydrocarbyl-terminated poly(oxyalkylene) monool in the fuel composition ranges from about 0.01 to 100 times the amount of hydrocarbyl-substituted amine or polyamine.

2. A fuel composition as defined in claim 1 wherein said hydrocarbyl-substituted amine or polyamine is a hydrocarbyl-substituted polyamine.

3. A fuel composition as defined in claim 2 wherein said hydrocarbyl-substituted polyamine is derived from a polyamine having from 2 to 12 amine nitrogen atoms and 2 to 40 carbon atoms and has a carbon-to-nitrogen ratio of from about 1:1 to about 10:1.

4. A fuel composition as defined in claim 3 wherein the polyamine is a polyalkylene polyamine having from 2 to about 12 amine nitrogen atoms and from 2 to about 24 carbon atoms.

5. A fuel composition as defined in claim 4 wherein the polyalkylene polyamine is ethylene diamine.

6. A fuel composition as defined in claim 1 wherein the hydrocarbyl-terminated poly(oxyalkylene) m has an average molecular weight of from about 900 to 1500.

7. A fuel composition as defined in claim 1 wherein the oxyalkylene group of the hydrocarbyl-terminated poly(oxyalkylene) monool is a $C_3$–$C_4$ oxyalkylene group.

8. A fuel composition as defined in claim 7 wherein the oxyalkylene group of the hydrocarbyl-terminated poly(oxyalkylene) monool is a $C_3$ oxypropylene group.

9. A fuel composition as defined in claim 7 wherein the oxyalkylene group of the hydrocarbyl-terminated poly(oxyalkylene) monool is a $C_4$ oxybutylene group.

10. A method of reducing the ORI of a fuel composition containing a hydrocarbyl-substituted amine or polyamine which comprises adding a hydrocarbyl-terminated poly(oxyalkylene) monool having a molecular weight of from about 500 to about 5,000 wherein said oxyalkylene group of the poly(oxyalkylene) monool is a $C_2$ to $C_5$ oxyalkylene group and the hydrocarbyl group of said hydrocarbyl poly(oxyalkylene) monool is a $C_7$–$C_{30}$ akylphenyl group and wherein the weight percent hydrocarbyl-terminated poly(oxyalkylene) monool in the fuel composition ranges from about 0.01 to 100 times the amount of hydrocarbylsubstituted amine or polyamine.

11. A method as defined in claim 10 wherein the hydrocarbyl-terminated poly(oxyalkylene) monool has an average molecular weight of from about 900 to 1500.

12. A method as defined in claim 10 wherein the oxyalkylene group of the hydrocarbyl-terminated poly-(oxyalkylene) monool is a $C_3$–$C_4$ oxyalkylene group.

* * * * *